US010487717B2

(12) United States Patent
Bruemmer et al.

(10) Patent No.: US 10,487,717 B2
(45) Date of Patent: Nov. 26, 2019

(54) COOLING CIRCUIT

(71) Applicant: MAHLE International GmbH, Stuttgart (DE)

(72) Inventors: Richard Bruemmer, Stuttgart (DE); Annegret Srnik, Esslingen (DE)

(73) Assignee: MAHLE International GmbH, Stuttgart (DE)

( * ) Notice: Subject to any disclaimer, the term of this patent is extended or adjusted under 35 U.S.C. 154(b) by 183 days.

(21) Appl. No.: 14/929,545

(22) Filed: Nov. 2, 2015

(65) Prior Publication Data

US 2016/0053666 A1 Feb. 25, 2016

Related U.S. Application Data

(63) Continuation of application No. PCT/EP2014/058593, filed on Apr. 28, 2014.

(30) Foreign Application Priority Data

May 3, 2013 (DE) ..... 10 2013 208 115

(51) Int. Cl.
*F01P 7/16* (2006.01)
*F01P 3/20* (2006.01)
*F01P 5/10* (2006.01)

(52) U.S. Cl.
CPC ..... *F01P 7/161* (2013.01); *F01P 3/20* (2013.01); *F01P 5/10* (2013.01); *F01P 2005/105* (2013.01)

(58) Field of Classification Search
CPC ..... F01K 23/065; F01K 23/10; F01K 9/003; F01P 2003/2292; F01P 2005/105; F01P 3/20; F01P 3/22; F01P 5/10; F01P 7/161
USPC ..... 123/41.1
See application file for complete search history.

(56) References Cited

U.S. PATENT DOCUMENTS 3,063,251 A * 11/1962 Jaremus ..... F25B 13/00 165/258
5,228,301 A * 7/1993 Sjoholm ..... B60H 1/00007 165/263
8,800,285 B2 8/2014 Ernst et al.
8,950,184 B2 2/2015 Stegmaier et al.
(Continued)

FOREIGN PATENT DOCUMENTS

DE 198 18 649 A1 10/1999
DE 102 03 293 A1 7/2003
(Continued)

OTHER PUBLICATIONS

Machine Translation of DE 102009028467 A1 PDF File Name: "DE102009028467A1_Machine_Translation.pdf".*

*Primary Examiner* — Grant Moubry
*Assistant Examiner* — Ruben Picon-Feliciano
(74) *Attorney, Agent, or Firm* — Muncy, Geissler, Olds & Lowe, P.C.

(57) ABSTRACT

A cooling circuit including a combustion engine, a coolant cooler, a first thermostat, a first pump, a condenser, a second thermostat and a second pump, wherein a cooling agent can flow through the cooling circuit, wherein the combustion engine, first pump, coolant cooler and first thermostat are arranged in a first circuit, and the condenser, second thermostat and second pump are arranged in a second circuit, and wherein the first circuit and second circuit are in fluid communication with one another at at least one point.

11 Claims, 6 Drawing Sheets

(56) References Cited

U.S. PATENT DOCUMENTS

| | | | | |
|---|---|---|---|---|
| 2001/0037873 | A1* | 11/2001 | Fredj | B60H 1/323 165/43 |
| 2009/0277400 | A1* | 11/2009 | Conry | F01N 5/02 123/2 |
| 2012/0198840 | A1* | 8/2012 | Stegmaier | F01K 9/003 60/605.1 |
| 2014/0326443 | A1* | 11/2014 | Kardos | F01P 7/165 165/287 |

FOREIGN PATENT DOCUMENTS

| | | | | |
|---|---|---|---|---|
| DE | 10 2006 043 139 | A1 | 3/2008 | |
| DE | 10 2009 028 467 | A | 2/2011 | |
| DE | 102009028467 | A1 * | 2/2011 | F01K 9/003 |
| DE | 10 2010 003 906 | A1 | 10/2011 | |
| DE | 10 2012 000 100 | A1 | 7/2012 | |
| EA | 101 28 877 | A1 | 12/2002 | |
| WO | WO 2012/021757 | A2 | 2/2012 | |

* cited by examiner

COOLING CIRCUIT

This nonprovisional application is a continuation of International Application No. PCT/EP2014/058593, which was filed on Apr. 28, 2014, and which claims priority to German Patent Application No. 10 2013 208 115.4, which was filed in Germany on May 3, 2013, and which are both herein incorporated by reference.

BACKGROUND OF THE INVENTION

Field of the Invention

The invention relates to a cooling circuit with a combustion engine, a coolant cooler, a first thermostat, a first pump, a condenser, a second thermostat and a second pump, wherein a coolant can flow through the cooling circuit, wherein the combustion engine, first pump, coolant cooler and first thermostat are arranged in a first circuit.

Description of the Background Art

To reduce fuel consumption in motor vehicles, systems can be used which utilize the energy bound in the hot exhaust gas. For this purpose, for example, waste heat recovery systems (WHR systems) can be used. The thermal energy of the exhaust gas is thereby converted into mechanical energy, which can be introduced, for example, in the drive train to thus support the propulsion of the vehicle. Alternatively, the mechanical energy can be used for generating electrical energy to, for example, operate a generator. The electrical energy generated can, for example, be supplied to the onboard electrical system, or temporarily stored in an energy storage device. For the conversion of the thermal energy, a thermodynamic cyclic process can be used. A working fluid can thereby be vaporized by the thermal energy of the exhaust gas and then relaxed in an expander with the release of mechanical energy. The resulting process heat can be advantageously dissipated via a cooling circuit. Preferably, the heat is removed at the lowest possible coolant temperature, while at the same time ensuring that it does not fall below a certain minimum temperature, which will depend on the physical properties of the working fluid.

For cooling, the cooling circuit may be used which is also used to cool the combustion engine. Alternatively, a separate, additional cooling circuit can be provided.

One disadvantage of the solutions in the prior art is in particular that additional outlay is caused by the additional cooling circuit for cooling the WHR system, which makes the system more complex and more costly. When using the cooling circuit of the combustion engine for the WHR system, problems arise with regard to the temperature in the cooling circuit because the temperature level of the coolant in the combustion engine is higher than the temperature level of the coolant in the WHR system. This results in adverse mutual influencing of the coolant temperature.

This problem also exists in other applications with one or more heat sources that additionally need to be cooled, and is not limited to vehicles with a WHR system. One example for other applications of the invention is the cooling of the electronic components in a hybrid vehicle. For the sake of simplicity, the below example refers to a WHR system.

SUMMARY OF THE INVENTION

It is the object of the present invention to provide a cooling circuit, having a WHR system and a combustion engine, wherein an optimized design of the cooling circuit is provided with regard to the occurring temperature levels.

An embodiment of the invention provides a cooling circuit of a combustion engine, a coolant cooler, a first thermostat, a first pump, a condenser, a second thermostat and a second pump, wherein a coolant can flow through the cooling circuit, and wherein the combustion engine, the first pump, the coolant cooler and the first thermostat are arranged in a first circuit. The condenser, second thermostat and second pump are arranged in a second circuit, wherein the first circuit and the second circuit are at least at one location in fluid communication with each other, with the first thermostat arranged in the first section. A coolant inlet and a coolant outlet are in fluid communication with the first section, and a coolant outlet is in fluid communication with the first bypass.

Sharing a cooling circuit for cooling both the combustion engine and the WHR system is particularly advantageous, since no additional, second cooling circuit needs to be integrated. An existing cooling circuit can be expanded for sharing. This reduces the number of additional parts required, thus reducing the overall cost of the system.

By subdividing the shared cooling circuit into two circuits that are in fluid communication with each other, the entire cooling circuit can be designed particularly advantageous in order to achieve optimum cooling for both circuits.

Moreover, it can be advantageous if the first circuit and the second circuit are in fluid communication with each other at three points.

By connecting the circuits at three points, a particularly advantageous coolant flow in the circuits can be achieved. The connections between the circuits thereby allow an overflow of the coolant between the two circuits, whereby an optimal cooling effect for different operating conditions can be achieved.

The combustion engine can be in fluid communication with the coolant cooler via a first section of the first circuit, and the coolant cooler can be in fluid communication with the first pump via a second section, wherein the first pump can be in fluid communication with the combustion engine, wherein the first section and the second section can be in fluid communication with each other via a first bypass and the first thermostat.

By designing the first circuit in such a manner, it is possible to have the coolant either circulate only through the coolant cooler, or to let the coolant only circulate past the coolant cooler, through a bypass. In this way, the coolant can be tempered as required, and a flow through both the coolant cooler and the bypass is also possible. For this purpose, the thermostat has a controller that allows for distribution to the individual flow sections of the circuit.

A coolant inlet of the condenser can be in fluid communication with the second pump via a third section, wherein the second pump can be in fluid communication with the second section via a seventh section and a coolant outlet of the condenser can be in fluid communication with the second section via a fourth section, and the fourth section further fluidly communicates with the second section or the seventh section via a second bypass and the second thermostat.

The structure described above of the second circuit is particularly advantageous. It allows the coolant to be taken from the primary circuit and moved into the first circuit through the condenser. The coolant can be moved into the first circuit from different points, whereby the temperature of the coolant can be influenced as required. For this purpose, the second thermostat can have a corresponding actuator, which can influence the coolant transition. Depending on the position of the second thermostat, the coolant thereby either flows in a small loop directly from the coolant outlet of the condenser to the coolant inlet of the condenser, or alternatively from the coolant outlet through the combustion engine, or through the combustion engine and the coolant cooler to the coolant inlet of the condenser. This enables a particularly ideal control of the coolant temperature for the condenser and/or the combustion engine.

In an embodiment, the second thermostat can be disposed in the seventh section or the fourth section, and fluid communication can be obtained between the seventh section and the fourth section over the second bypass and the second thermostat.

This is particularly advantageous for realizing a very small loop for the coolant, wherein the coolant flows directly from the coolant outlet of the condenser to the coolant inlet of the condenser. The second thermostat can be situated either directly upstream of the coolant inlet or directly downstream of the coolant outlet. Either way, by positioning the adjustor in the second thermostat, the coolant transition is directed into the second bypass or out of the second bypass.

In an embodiment of the invention, the second thermostat can be disposed in the fourth section, and a fluid communication can be obtained between the fourth section and the second section through the second bypass and the second thermostat.

When the second thermostat is arranged in the fourth section, it can be arranged downstream of the coolant outlet of the condenser. In a configuration as described above, the second thermostat directs the coolant transition of the coolant from the fourth section along the second bypass into the second section or alternatively, directs the transition of the coolant from the fourth section directly into the second section. Depending on the position of the actuator the second thermostat, a coolant transition can occur both over the second bypass as well as directly into the second section.

In an embodiment of the invention, the first thermostat may be arranged in the second section, wherein a first coolant inlet of the first thermostat can be in fluid communication with the first bypass, and a second coolant inlet and a coolant outlet, respectively, can be in fluid communication with the second section.

An arrangement of the first thermostat in the second section is particularly advantageous to influence the flow through the first bypass and/or the coolant cooler. Depending on the position of the adjustor in the first thermostat, the coolant can flow either from the first bypass directly into the second section in the direction of the combustion engine, or out of the second section of the coolant cooler into the second section, towards the combustion engine.

The second bypass can be in fluid communication with the second section, upstream of the first thermostat, and the fourth section can be in fluid communication with the second section, downstream of the first thermostat.

Such a connection of the second circuit to the first circuit can allow a flow of coolant from the second circuit in the area of the second section that is situated upstream of the first thermostat, as well as a flow of coolant from the second circuit into the area of the second section that is located downstream of the first thermostat. This way, the coolant can either be fed directly into the first circuit or through the combustion engine. This enables a satisfactory tempering of the coolant.

Furthermore, the fourth section can be in fluid communication with the second section, upstream of the first thermostat.

Such a connection of the second circuit to the first circuit can allow the coolant to always first flow through the combustion engine before it can overflow into the second circuit.

In an embodiment of the invention, a fifth section can be in fluid communication with the second section and/or the fourth section and/or the first bypass.

A fifth section may allow the coolant from the second circuit and/or the coolant from an area of the second section, which is situated upstream of the first thermostat, to not directly flow to the first thermostat but instead first flow into the first bypass and from there, into the first thermostat. This way, the temperature of the coolant, which acts on the first thermostat, can be more advantageously influenced, since the coolant from the first bypass and the coolant from the second circuit are already mixed upstream of the first thermostat. This is particularly advantageous when the adjustor in the first thermostat is sensitive to temperature.

Furthermore, the first thermostat can be arranged in the first section, and a coolant inlet and a coolant outlet can be in fluid communication with the first section, and a coolant outlet can be in fluid communication with the first bypass.

An arrangement of the first thermostat in the first section represents an arrangement of the first thermostat, downstream of the coolant outlet of the combustion engine. As the coolant there has a different temperature level than upstream of the coolant inlet of the combustion engine, a different design of the first thermostat may be required. Under certain circumstances, this may allow for an optimized influencing of the coolant temperature.

The coolant transition between a coolant inlet and a coolant outlet of the first thermostat and/or the second thermostat can be influenced by the adjustor.

The adjustor can be formed, for example, by temperature-sensitive elements that respond to the temperature of each incoming coolant. In this way, the entire cooling circuit can be controlled in accordance with the temperature levels of the coolant at the respective thermostats. The actuator can also be actively heated from the outside, whereby improved control of the cooling circuit is made possible. The actuator can also be formed by actuators which can be adjusted via control signals from the outside.

Depending on the position of the adjustor, the coolant can be allowed to flow from a coolant inlet directly to the coolant outlet of the thermostat. Alternatively, a mixing position which enables a simultaneous flow of coolant from both coolant inlets to the coolant outlet can also be attained. Using such a mixing position, an especially advantageous control of the coolant temperature can also be attained.

Moreover, a check valve can be disposed in the second section and/or the fifth section, which prevents a reversal of flow direction in the respective section.

Non-return valves can ensure that the coolant flow in certain areas of the cooling circuit does not undergo reverse flow. Such a flow reversal can occur in subsections of the first and/or the second circuit, depending on the position of the various thermostats. Depending on the design of the cooling circuit, the positioning of one or more check valves can influence the coolant flow in a particularly advantageous manner.

In addition, the second section can be in fluid communication with the first section via a sixth section.

Such a design is particularly advantageous since a greater variability of the cooling circuit can be obtained.

A pressure relief valve can be disposed in the sixth section, wherein the pressure relief valve can be opened or closed based on, for example, the position of the actuator in the thermostat.

Via an additional, controllable or adjustable pressure relief valve, the coolant flow can be even more advantageously adapted to the particular operating situation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
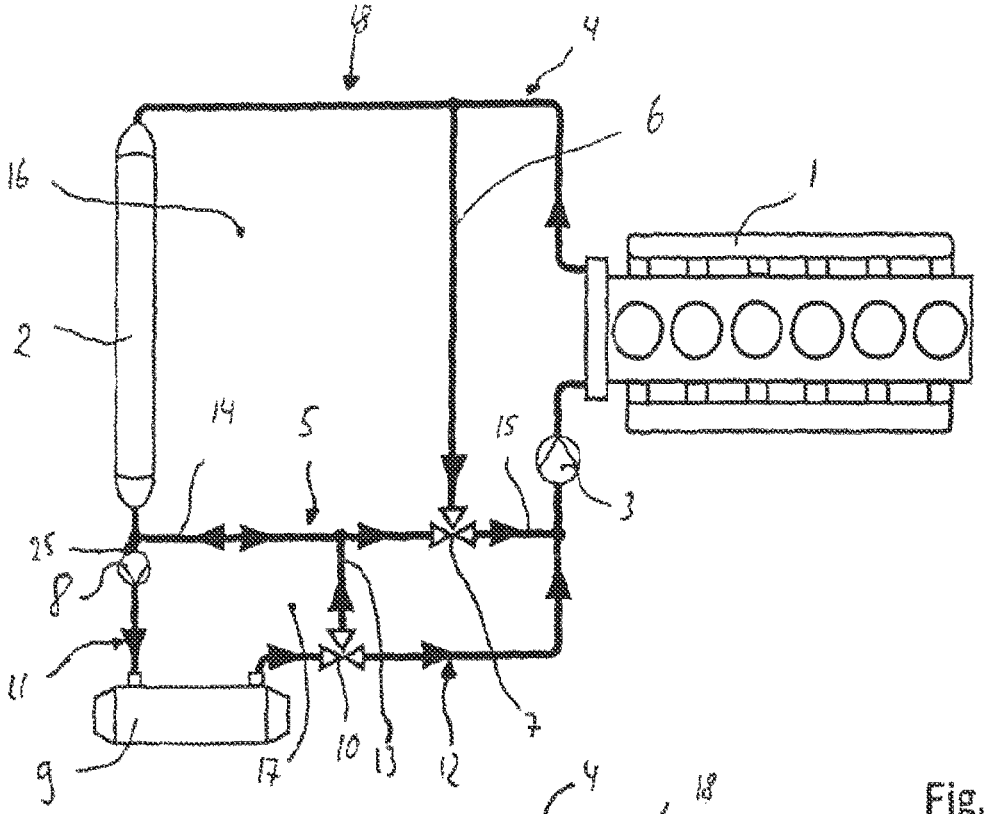
FIG. 1 is a schematic view of a cooling circuit, wherein the cooling circuit is divided into two circuits which are in fluid communication with each other at three points.

FIG. 1 shows a schematic view of a cooling circuit 18. The cooling circuit 18 includes a first circuit 16 and a second circuit 17, wherein the circuits 16, 17, are interconnected at several points in such a way that an exchange of the coolant flowing through the circuits 16, 17 is possible.

The first circuit 16 has a combustion engine 1, a coolant cooler 2 and a first pump 3. Starting from the combustion engine 1, a coolant can flow along a first section 4 to the coolant cooler 2. From the output of the coolant cooler 2, the coolant can flow along a second section 5 to the first pump 3 and from there, into the combustion engine 1.

In addition, the first circuit 16 has a first bypass 6 which connects the first section 4 to the second section 5. Over the bypass 6, it is possible that the coolant flows in a small loop starting from the combustion engine 1, over the bypass 6, through the pump 3, to the combustion engine 1. Along a large loop, the coolant can flow from the combustion engine 1, past the bypass 6, through the coolant cooler 2, via the second section 5 to the pump 3, into the combustion engine 1. A thermostat 7 is situated at the interface between the bypass 6 and the second section 5.

The thermostat 7 regulates the distribution of the coolant between the bypass 6 and the remaining circuit 16.

For this purpose, the thermostat 7 may have an adjustor, which may affect the connection, in particular the flow cross-section between the two fluid inlets and the fluid outlet. In this way, it can be achieved that the fluid inlet, which is in fluid communication with the first area of the second section 14, is closed, while the fluid inlet, which is in fluid communication with the bypass 6, is fully open. In this case, the coolant flows along the bypass 6 into the second area 15 of the second section 5 and from there, via the pump 3 into the combustion engine 1. Between the extreme positions, which in each case close one of the fluid inlets, a mixing position can also be provided, which allows a fluid flow through both the bypass 6 and the second section 5.

The second circuit 17 has a second pump 8, a condenser 9 and a thermostat 10. The pump 8 is arranged between a seventh section 25 and a third section 11, and is located upstream of the condenser 9. The pump 8 in turn is in fluid communication with the second section 14 of the first circuit 16. A fourth section 12 extends from the fluid outlet of the condenser 9, which in turn is in fluid communication with the second area 15 of the second section 5. In FIG. 1, a bypass 13 is shown, which starts from the thermostat 10 that is arranged in the fourth section 12 and which connects the fourth section fluidically with the first area 14 of the second section 5.

The thermostat 10 is thereby constructed analogously to the first thermostat 7 described above. Accordingly, the thermostat also enables a position with an open fluid inlet and a closed fluid inlet, as well as a mixing position, which allows for two at least partially open fluid inlets.

The second thermostat 10 allows the coolant to flow in a small loop from the fluid outlet of the condenser 9 via the thermostat 10 through the bypass 13 into the first section 14 of the second section 5. From there, the fluid may either flow to the left, in direction of the second flow pump 8, or to the right, toward the thermostat 7. Alternatively, the second circuit can be perfused in such a way, that a coolant from the fluid outlet of the condenser 9 can flow through the thermostat 10 to the interface between the fourth section 12 and the second area of the second section 5. From there, the coolant can flow through the pump 3 into the combustion engine 1, and, depending on the position of the first thermostat 7, either through the bypass 6 or through the coolant cooler 2.

The coolant flowing through the coolant cooler 2 can then either flow into the second circuit 17 via the pump 8 or flow along the first area 14 of the second section 5 in the direction of the first thermostat 7.

In this way, a variety of coolant mixtures from the first circuit 16 and the second circuit 17 are possible. Depending on the design of the thermostats 7 or 10, and in particular on their operating temperatures, a highly variable mix of coolant streams in the cooling circuit 18 can be achieved.

The construction of the cooling circuit 18 in FIG. 1 is exemplary and may also differ in alternative embodiments, in particular in terms of the interfaces between the second circuit 17 and the first circuit 16.

In the following figures, various operating conditions of the cooling circuit 18 illustrated in FIG. 1 are shown. The numerals of the following figures correspond to those in FIG. 1 and, if necessary, are supplemented by additional references.

Figure 2:
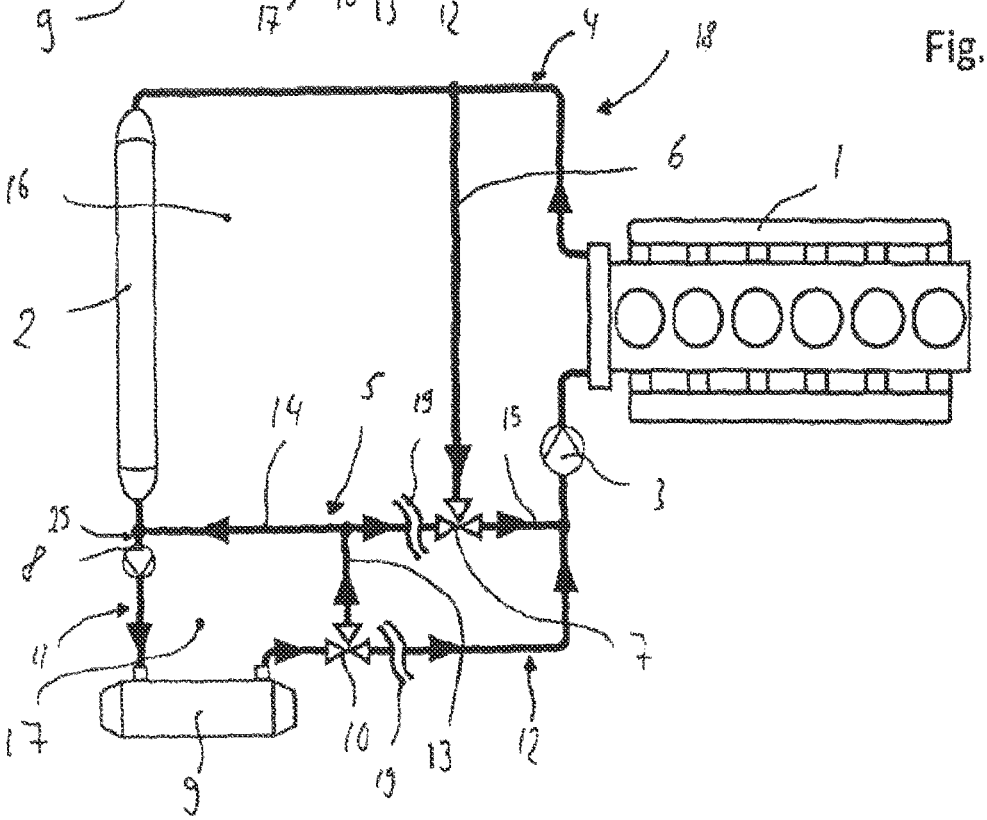
FIG. 2 is a schematic view of a cooling circuit according to FIG. 1, wherein a condition is shown which corresponds to the cold start of the combustion engine.

FIG. 2 shows a cooling circuit 18 according to FIG. 1. In FIG. 2, a control state is shown which corresponds to a cold start of the combustion engine 1. In order to bring the combustion engine 1 up to operating temperature as quickly as possible, the flow path to the coolant cooler 2 is interrupted by closing the thermostat 7. This is shown by the upper gap 19. The coolant can thus only flow from the combustion engine 1 via the first section 4 into the bypass 6, and from there via the thermostat 7 to the pump 3 and into the combustion engine 1.

In the second circuit 17, the flow path is blocked via the thermostat 10 in such a way, that a coolant starting from the condenser 9 flows via the thermostat 10 into the first area 14 of the second section 5, and due to the blockage 19 of the thermostat 7, flows in the direction of the pump 8 and from there, is fed via the third section 11 into the condenser 9.

Thus, in the state shown in FIG. 2, no coolant flows through the coolant cooler 2. This in particular helps to speed heating of the coolant within the combustion engine 1.

The coolant in the second circuit 17 heats up to the point at which the actuating temperature of the thermostat 10 is reached. Upon reaching the temperature, the fourth section 12 is released, whereby coolant, which has passed through the condenser 9, flows in the direction of the pump 3 and then into the combustion engine 1. Due to the flow-out of the heated coolant from the second circuit 17, coolant which is jammed inside the coolant cooler 2 now flows to the second circuit 17. Consequently, the coolant temperature in the second circuit 17 again decreases. As a consequence, it is possible that the second thermostat 10 again closes. If the heating of the coolant in the circuit 17 occurs to such an extent that a decrease in temperature does not take place due to the coolant inflowing from the coolant cooler 2, at least the heating of the coolant in the circuit 17 is slowed.

Figure 3:
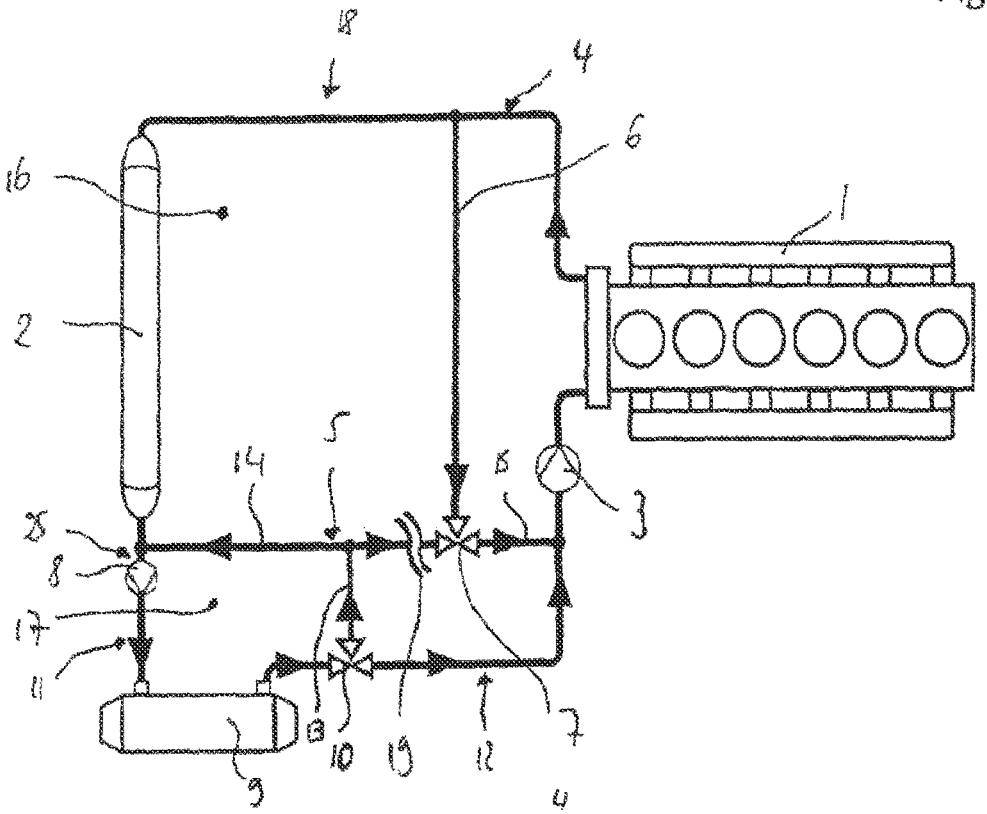
FIG. 3 is a schematic view of a cooling circuit according to FIGS. 1 and 2, wherein a condition is shown which corresponds to the warm-up of the combustion engine.

FIG. 3 shows a representation of the cooling circuit 18 in an operating mode referred to as a warm-up phase of the combustion engine 1. Since the combustion engine 1 has a large thermal inertia and the thermostat 7 regularly features a higher operating temperature than the thermostat 10, it can be assumed that the first thermostat 7 opens only after the second thermostat 10 has opened.

This state is shown in FIG. 3. The blockage 19 indicates that no coolant flows from the outlet of the coolant cooler 2 along the second section in the direction of the thermostat 7.

The operating temperature of the second thermostat 10 is regularly chosen depending on the working fluid used in the condenser 9. The working fluid thereby designates the fluid which is used within the WHR system for heat transfer. The operating temperature of the thermostat 10 routinely lies below the operating temperature of the first thermostat 7.

FIG. 3 shows a state that has already been shown in FIG. 2, wherein, however, the blockage 19 behind the second thermostat 10 was already repealed. Here, heated coolant flows from the condenser along the fourth section 12 in the direction of the pump 3 and finally into the combustion engine 1. As mentioned above, cold coolant flows from the coolant cooler 2 to the second circuit 17, whereby the rise in temperature in the second circuit 17 is slowed down or even reversed, and whereby cooling can be achieved.

In the phase in which the first thermostat 7, as shown in FIG. 3, is still closed, the coolant flow along the cooling circuit 18 is completely controlled by the second thermostat 10. The thermostat 10 is mainly tailored to the temperature requirement of the condenser 9.

When the temperature of the coolant flowing through the bypass further increases until it finally actuates the thermostat 7, the thermostat opens 7, so that the upper block 19 is also repealed. A state is then reached that corresponds to the basic state of the cooling circuit 18, as was shown in FIG. 1.

Since coolant flow can now proceed from the coolant cooler 2 to the pump 3 and through the second section 14, it may be necessary to increase the capacity of the pump 8 of the second circuit 17 to still be able to provide the condenser 9 with an adequate supply of coolant.

In extreme cases, it can happen that the entire coolant flow is conveyed from the coolant cooler 2 via the pump 8 into the condenser 9. This may even cause a reversal of flow in the first area of the second section 14, whereby in the first region 5 of the second section 14, the coolant flows from the first thermostat 7 in the direction of the pump 8.

Such effects can be influenced by the delivery capacity of the pumps 3 or 8, or via the opening and closing timings of the thermostats 7 and 10. By maintaining an interconnection between the first circuit 16 and the second circuit 17 as shown in FIGS. 1 to 3, a great variability can be achieved with regard to the coolant flow in the cooling circuit 18.

At maximum cooling power demand, both thermostats 7, 10 are fully opened in the first circuit 16 as well as in the second circuit 17, and the maximum amount of coolant flows through the coolant cooler 2. At the outlet of the coolant cooler 2, the coolant flow is divided, wherein a part of the coolant flows in the direction of the pump 8, and another part of the coolant flows in the direction of the first thermostat 7. After flowing through the condenser 9, the portion of the coolant that was diverted into the second circuit 17 is again sent along the fourth section 12 in the direction of the pump 3, and fed into the first circuit 16. The entire coolant thereby flows through the coolant cooler 2 and the combustion engine 1. The bypasses 6 or 13 shown can thereby be slightly perfused by thermal effects.

It should be noted that the runtime which the coolant requires from the outlet of the condenser 9 to the second thermostat 10 is to be regarded as idle time for any regulation or control of the thermostat 10. For this reason, the coolant line between the condenser outlet 9 and the thermostat 10 should be kept as short and thin as possible in order to keep the resulting idle time as short as possible, and thus generate a system that is as dynamic as possible.

In regards to the state of the cooling circuit 18 shown in FIG. 3, in which the flow of the coolant from the coolant cooler 2 is still suppressed by the thermostat 7, it is possible for the coolant inlet temperature at the combustion engine 1 to lie above the actuation temperature of the thermostat 7. This can happen especially when the heat input via the condenser 9 is particularly high. The coolant temperature occurring at the coolant inlet of the combustion engine 1, however, is usually not higher than it would be if the main branch, i.e. the path from the coolant cooler 2 through the thermostat 7 to the combustion engine 1, were fully open.

In an alternative embodiment, the thermostat 7 can also be arranged at the coolant outlet of the combustion engine 1. The coolant would then flow directly from the coolant outlet of the combustion engine 1 into the alternative thermostat, and the thermostat would distribute the coolant to the bypass 6 or the flow path towards the coolant cooler 2. In such a case, the actuating temperatures of the two thermostats must be adapted to one another such that a stable system behavior is achieved.

Figure 4:
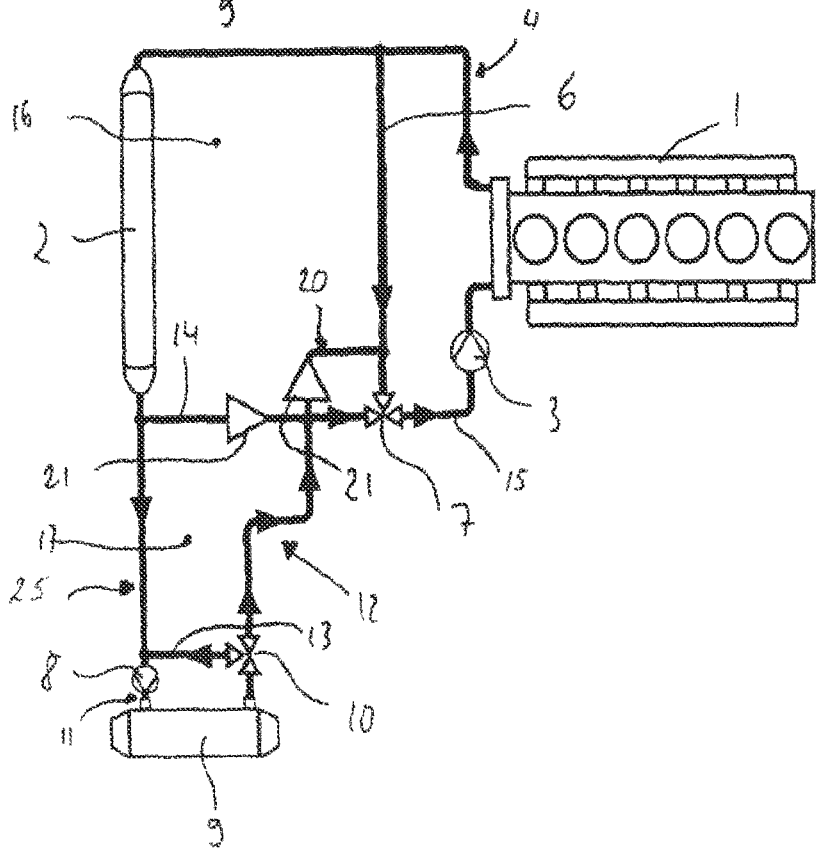
FIG. 4 is a schematic view of a cooling circuit, wherein the connection of the two circuits to one another differs from FIGS. 1 to 3, and additionally check valves are integrated in the cooling circuit.

FIG. 4 shows a different design of the cooling circuit 18. Whereas the first circuit 16 is largely unchanged, in the second circuit 17, the bypass 13 is now arranged such that it connects the fourth section 12 with the seventh section 25. The second thermostat 10 is thereby arranged in the fourth section 12 such that the coolant flowing out of the condenser 9 via the thermostat 10 is divided across the bypass 13 and the fourth section 12. After the bypass 13, the coolant flows through the pump 8 and again flows into the condenser 9. In the event that the coolant flows along the fourth section 12, the coolant may either flow directly into the thermostat 7 over an intersection with the first area 14 of the second section 5, or flow via a fifth section 20, which is in fluid communication with the first bypass 8, into the first bypass 6 and from there, into the first thermostat 7. From the first thermostat 7, the coolant can then flow through the pump 3 into the combustion engine 1. In both the first area 14 of the second section 5, and in the fifth section 20, check valves 21 are arranged. These should on the one hand prevent a flow of coolant from the bypass 6 to the fourth section 12, and on the other hand, a flow of coolant from the fourth section 12 along the first area 14 of the second section 5 toward the seventh section 25.

Figure 5:
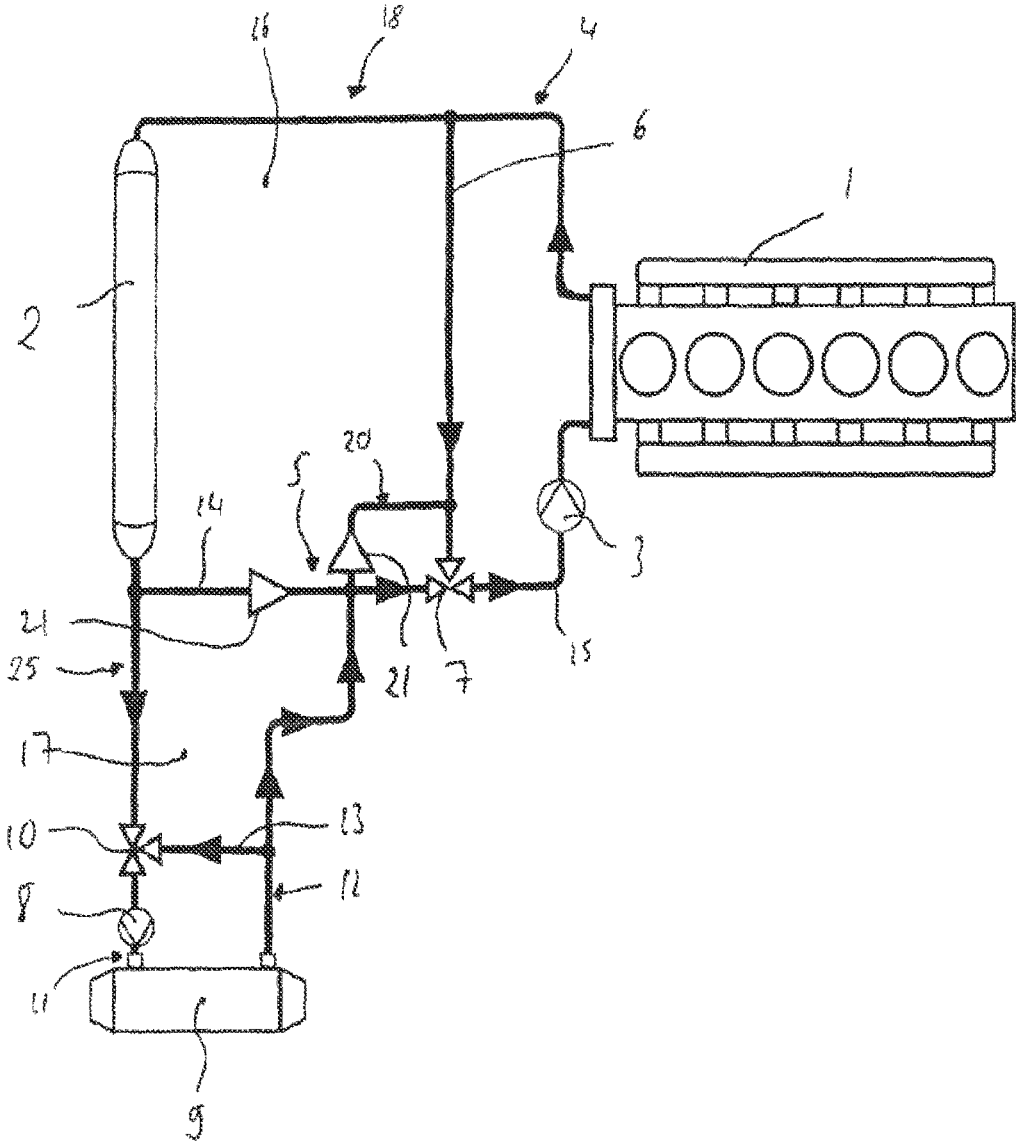
FIG. 5 is a schematic view of a cooling circuit, wherein the arrangement of a thermostat differs from the illustration in FIG. 4.

FIG. 5 shows a similar arrangement as FIG. 4. The second thermostat is arranged between the seventh section 25 and the third section 11. The second thermostat 10 is therefore disposed upstream of the pump 8 and the coolant inlet of the condenser 9, and at the end region of the bypass 13. Otherwise, FIG. 5 is equal to the previously described FIG. 4.

Figure 6:
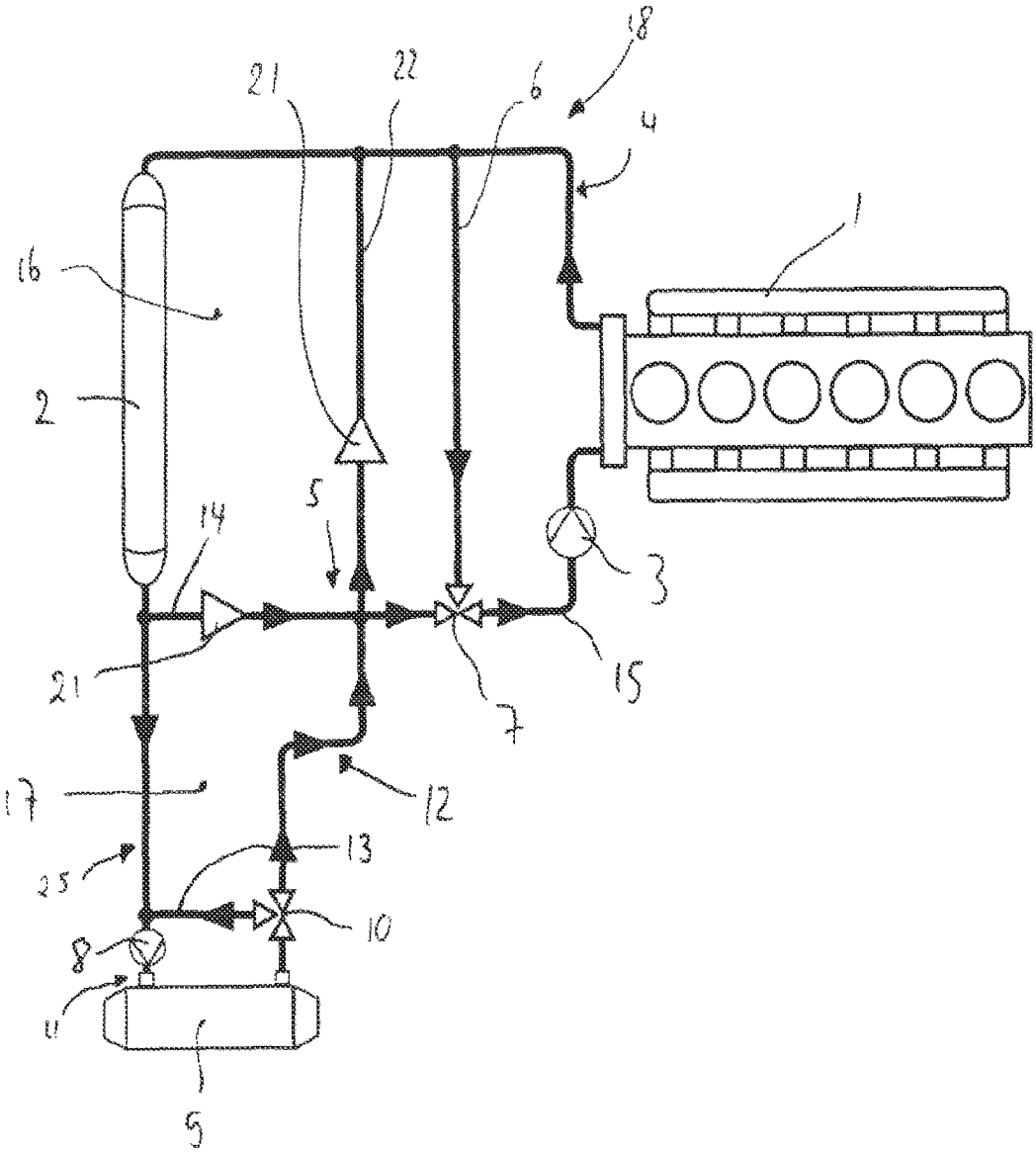
FIG. 6 is a further schematic view of a cooling circuit, wherein an additional section is provided which connects the first section with the second section parallel to the first bypass, wherein the flow direction in the additional section is preferably oriented against the flow direction in the first bypass.

FIG. 6 shows a different design of the cooling circuit 18. Whereas the first circuit 18 is largely unchanged, in the second circuit 17, the bypass 13 is now arranged such that it connects the fourth section 12 with the seventh section 25. The second thermostat 10 is thereby arranged in the fourth section 12 such that the coolant flowing out of the condenser 9 is divided across the bypass 13 and the fourth section 12 via the thermostat 10. After the bypass 13, the coolant flows through the pump 8 and flows into the condenser 9.

In the event that the coolant flows along the fourth section 12, the coolant may either flow over an intersection with the first area 14 of the second section 5 directly into the thermostat 7, or flow via a sixth section 22, which is in fluid communication with the first area 4, into the first section 4, and from there either through the first section 4 into the first bypass 6 or into the coolant cooler 2. The coolant can flow through the bypass 6 to the first thermostat 7, and from the first thermostat 7, flow through the pump 3 into the combustion engine 1.

Alternatively, the coolant flows along the sixth section 22 into the coolant cooler 2, and from there, either into the seventh section 25 or into the first area 14 of the second section 5.

In the sixth section 22, a check valve 21 is arranged, which prevents a reverse flow of the coolant through the sixth section 22. Furthermore, a second check valve is disposed in the first area 14 of the second section 5. The second check valve is intended to prevent return flow of the coolant from the fourth section 12 along the first area 14 of the second section 5 toward the seventh section 25.

Figure 7:
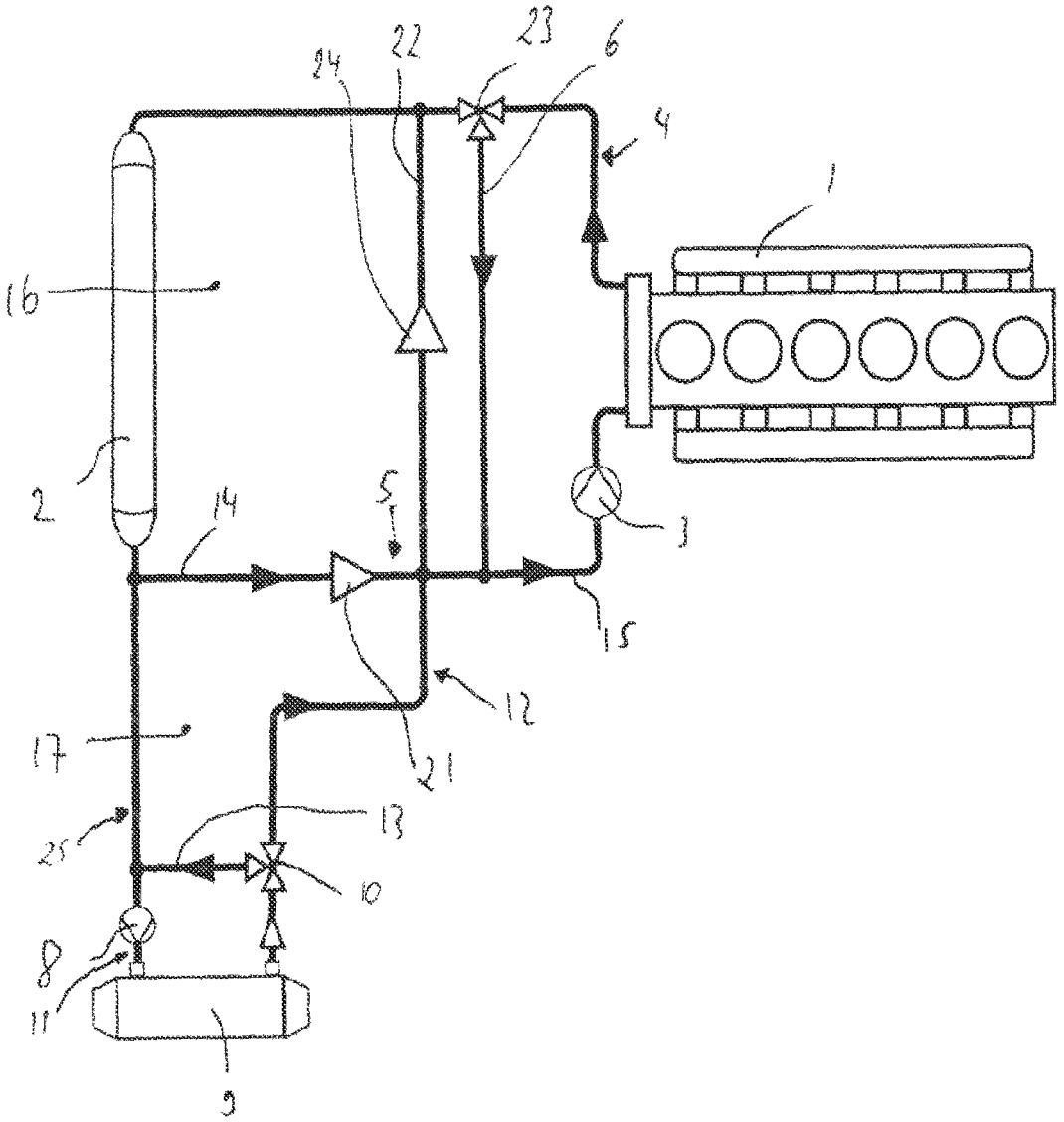
FIG. 7 is a further schematic view of a cooling circuit according to FIG. 6, wherein the first thermostat is disposed at a different point.

FIG. 7 shows a configuration of the cooling circuit 18 which is very similar to the configuration in FIG. 6. Deviating from FIG. 6, the first thermostat 23 is now not located between the first area 14 and second area 15 of the second section 5, but instead, in the first section 4. The first thermostat 23 thus separates the coolant flow, which, coming from the combustion engine 1, ends on a path leading to the coolant cooler 2, and on another path that leads into the first bypass 6.

In the sixth section 22, a pressure relief valve 24 is arranged which is opened only when the first thermostat 23 is closed.

Figure 8:
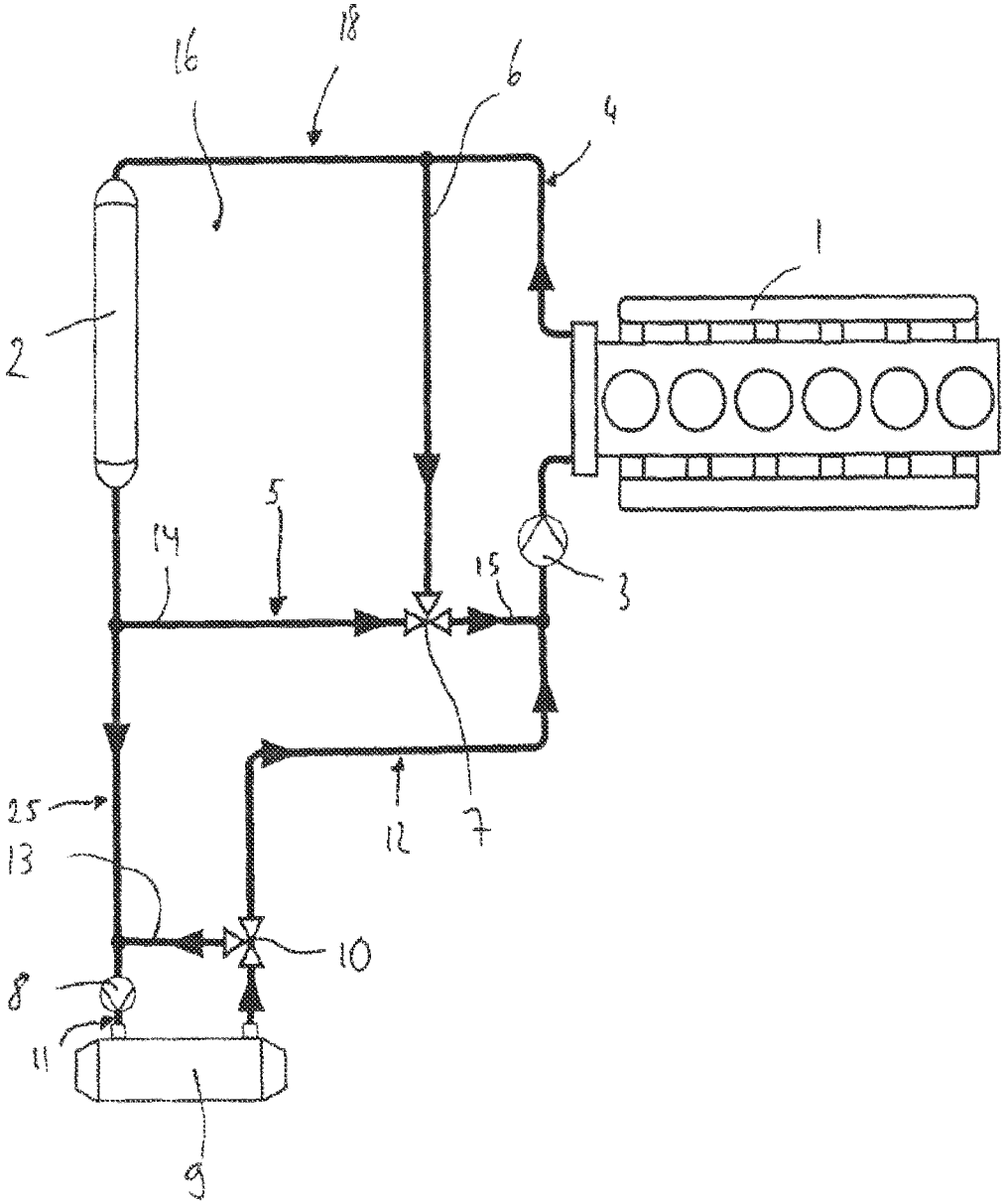
FIG. 8 is another schematic view of a cooling circuit, wherein upstream of the first thermostat, no return from the second circuit into the first circuit is provided.

FIG. 8 shows a representation of the cooling circuit 18 in a further, alternative configuration. The structure of the first circuit 16 corresponds to the structure in FIGS. 1 to 3.

The second circuit 17 corresponds in many parts to the design of the second circuit 17 shown in FIG. 4. Contrary to FIG. 4, no check valves are provided in FIG. 8.

In FIG. 8, the fourth section 12 leads to an intersection with the second area 15 of the second section 5. This intersection is located downstream of the first thermostat 7. The intersection point is arranged downstream of the first thermostat 7 and upstream of the first pump 3.

Furthermore, FIG. 8 does not have a fifth section 20 which establishes a fluid communication between the first area 14 of the second section 5 and the first bypass 6.

A design of the cooling circuit 18 shown in FIGS. 1 to 8 can achieve that both the condenser 9 and the combustion engine 1 are each operated at the best possible operating temperatures of the coolant.

By connecting the second circuit 17, coolant is available at the coldest possible temperature level for cooling the condenser 9. At the same time, the second thermostat 10 ensures that the coolant circulating in the second circuit 17 reaches an optimal operating temperature level as soon as possible, and that a sub-cooling of the coolant is avoided during operation. The position of the second thermostat 10 at the outlet side of the condenser 9, in particular, has its advantages, since with the high waste heat, the condenser inlet temperature is automatically reduced, thus maintaining the condensation pressure for different operating points and the coolant mass flows largely constant.

The second pump 8 in the circuit 17 ensures an optimum coolant flow rate. Furthermore, the thermal inertia of the second thermostat 10 reduces the probability of the occurrence of thermal stresses in the condenser 9, which may occur due to strong temperature fluctuations. In addition, the thermal inertia of the second thermostat 10 and thus the slower change in the coolant inlet temperature of the condenser 9 help to accommodate, in particular, the controllability of the working fluid, which is cooled in the condenser 9.

All embodiments shown in FIGS. 1 to 8 have an exemplary character and are intended to illustrate the inventive concept. They can be combined with each other. This is especially true for the interconnections of the cooling circuits shown, and also for the arrangement of the check valves or pressure relief valves and the thermostats.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A cooling circuit comprising:

a combustion engine;

a coolant cooler;

a first thermostat;

a first pump;

a condenser;

a second thermostat; and a second pump, wherein a coolant is adapted to flow through the cooling circuit, wherein the combustion engine, the first pump, the coolant cooler and the first thermostat are arranged in a first circuit, wherein the condenser, the second thermostat and the second pump are arranged in a second circuit, wherein the first circuit and the second circuit are in fluid communication with one another at at least one point, wherein a coolant inlet and a coolant outlet are in fluid communication with the first circuit, wherein the coolant outlet is in fluid communication with a first bypass provided in the first circuit, wherein the second circuit is provided with a second bypass, wherein the first circuit includes a first section and a second section and the second circuit includes a third section and a fourth section, wherein the second thermostat has a first coolant outlet that directly opens into the second bypass and a second coolant outlet that directly opens into the fourth section, and wherein coolant flowing through the second bypass enters back into either the first circuit or the second circuit at a point that is downstream of the coolant cooler and coolant flowing through the fourth section enters back into the first circuit at a point that is downstream of the coolant cooler.

2. A cooling circuit according to claim 1, wherein fluid communication is achieved via the second bypass and the second thermostat between the fourth section and the second section.

3. A cooling circuit according to claim 2, wherein the first thermostat is arranged in the second section, wherein a first coolant inlet of the first thermostat is in fluid communication with the first bypass, and a second coolant inlet and a coolant outlet of the first thermostat are each in fluid communication with the second section.

4. A cooling circuit according to claim 3, wherein the second bypass is in fluid communication with the second section upstream of the first thermostat, and the fourth section is in fluid communication with the second section downstream of the first thermostat.

5. A cooling circuit according to claim 3, wherein the fourth section is in fluid communication with the second section upstream of the first thermostat.

6. A cooling circuit according to claim 3, wherein the second circuit includes a fifth section, wherein the fifth section is in fluid communication with the second section and/or with the fourth section and/or with the first bypass.

7. A cooling circuit according to claim 1, wherein a coolant transition is influenced by an adjustor arranged between a coolant inlet and a coolant outlet of the first thermostat and/or the second thermostat.

8. A cooling circuit according to claim 1, wherein the second circuit further includes a fifth section, and wherein in the second section and/or the fifth section, a check valve is arranged that prevents a reversal of a flow direction in the second or fifth section.

9. A cooling circuit according to claim 3, wherein the first circuit includes a sixth section, and wherein the second section is in fluid communication with the first section via the sixth section.

10. A cooling circuit according to claim 9, wherein a pressure relief valve is arranged in the sixth section, wherein the pressure relief valve is opened or closed based on a position of the actuator in the first thermostat.

11. A cooling circuit according to claim 1, wherein coolant flowing through the first circuit enters into the second circuit and exits from the second circuit at points that are each downstream of the coolant cooler.

* * * * *